US005153376A

United States Patent [19]

Tomita

[11] Patent Number: 5,153,376

[45] Date of Patent: Oct. 6, 1992

[54] DEVELOPING SLEEVE WITH AXIALLY PARALLEL GROOVES FOR A MAGNETIC BRUSH DEVELOPING UNIT

[75] Inventor: Shoji Tomita, Yao, Japan

[73] Assignee: Mita Industrial Co., Ltd., Osaka, Japan

[21] Appl. No.: 655,514

[22] Filed: Mar. 6, 1990

[30] Foreign Application Priority Data

Mar. 9, 1989 [JP] Japan ..... 1-56798

[51] Int. Cl.[5] ..... G03G 15/09

[52] U.S. Cl. ..... 118/657; 355/251

[58] Field of Search ..... 355/251, 253, 259, 245; 118/656, 657, 658, 661

[56] References Cited

U.S. PATENT DOCUMENTS

| | | | |
|---|---|---|---|
| 4,018,187 | 4/1977 | Abbott et al. | 118/658 |
| 4,368,971 | 1/1983 | Watanabe et al. | 118/657 X |
| 4,377,332 | 3/1983 | Tamura | 118/658 X |
| 4,389,113 | 6/1983 | Matsumoto et al. | 118/658 X |
| 4,646,677 | 3/1987 | Lounsbury, Jr. et al. | 118/658 X |
| 4,786,936 | 11/1988 | Ikegawa et al. | 118/657 X |
| 4,982,689 | 1/1991 | Honda et al. | 118/656 |

FOREIGN PATENT DOCUMENTS

| | | | |
|---|---|---|---|
| 53-3347 | 1/1978 | Japan . | |
| 0161565 | 12/1981 | Japan | 118/657 |

*Primary Examiner*—A. T. Grimley
*Assistant Examiner*—William J. Royer
*Attorney, Agent, or Firm*—Armstrong & Kubovcik

[57] ABSTRACT

A developing sleeve for a magnetic brush developing unit, which is provided with a plurality of axially parallel grooves formed at a predetermined pitch in the circumferential direction on the surface thereof, is disclosed. Each of the grooves and the interfacing portion between each groove and its adjacent circumferential surface curve gradually and gently in section in the circumferential direction of the developing sleeve. The pitch for the formation of the grooves is set to be equal to or larger than the difference in travel length between the surface of the developing sleeve and that of a photosensitive drum during the time required for a point on the photosensitive drum to move along the full length of a developing area.

6 Claims, 2 Drawing Sheets

Fig.1
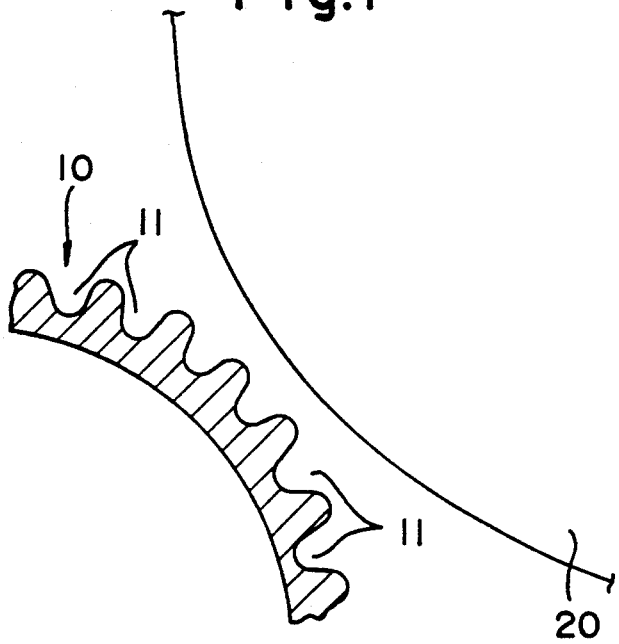
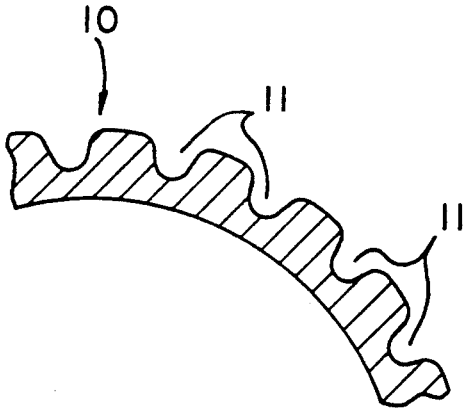
Fig.2
Fig.3
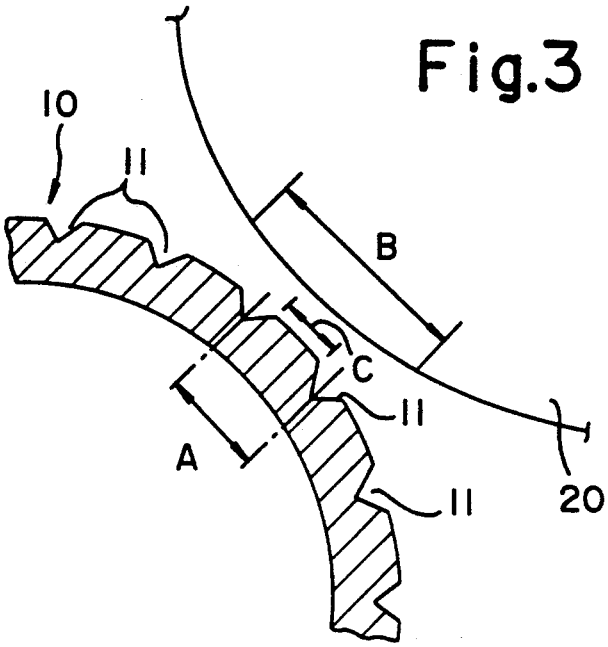

DEVELOPING SLEEVE WITH AXIALLY PARALLEL GROOVES FOR A MAGNETIC BRUSH DEVELOPING UNIT

BACKGROUND OF THE INVENTION

1. Field of the Invention

The present invention relates to a developing sleeve for a magnetic brush developing unit used in an image forming apparatus such as an electrophotographic copying machine or the like.

2. Description of the Prior Art

In an image forming apparatus such as an electrophotographic copying machine or the like, a developing unit is used to develop an electrostatic latent image formed on a photosensitive drum. As one of such developing units, a magnetic brush developing unit is known which is provided with a cylindrical developing sleeve having a plurality of magnets contained therein, the developing sleeve being rotated to form on the outer circumferential surface thereof a magnetic brush from developer consisting of toner and carrier. In this type of magnetic brush developing unit, as the developing sleeve rotates, the magnetic brush formed thereon rubs against the surface of a photosensitive drum, which is also rotating, in a developing area where the magnetic brush faces the photosensitive drum, to develop the electrostatic latent image on the photosensitive drum with the toner in the magnetic brush.

As disclosed in Japanese Laid-Open Patent Publication No. 53-3347, such a magnetic brush developing unit is provided with a plurality of axially parallel grooves of a prescribed shape arranged with appropriate spacing in a circumferential direction on the surface of the developing sleeve. With such grooves formed on the surface of the developing sleeve, carrier particles to which toner adheres can smoothly flow to the developing area facing the photosensitive drum. This allows the carrier particles having the toner adhering thereto to circulate within the developing area, thereby enabling the toner to properly develop the electrostatic latent image on the photosensitive drum.

However, when grooves having angular corners are formed on the surface of the developing sleeve, the distance between the surface of the developing sleeve and that of the photosensitive drum changes abruptly at positions where the grooves are formed, which causes the strength of the electric field applied to the developing area to change suddenly. Furthermore, the bristles of the magnetic brush erect differently in the grooves than in the other circumferential areas of the developing sleeve. Thus, when an image is to be formed which has portions the whole area of which are colored with the toner (these portions are hereinafter referred to as "solid-color areas") such as when copying a photograph, unevenness in toner density may be caused in the solid-color areas. In particular, as the ratio of the surface speed of the developing sleeve to that of the photosensitive drum is reduced, the magnetic brush formed from the developer carried on the developing sleeve is caused to contact the electrostatic latent image on the photosensitive drum for a longer time in the developing area, thereby making the density unevenness in the solid-color areas further noticeable.

SUMMARY OF THE INVENTION

It is a primary object of the present invention, which overcomes the above-discussed and numerous other disadvantages and deficiencies of the prior art, to provide a developing sleeve for a magnetic brush developing unit, which is capable of substantially reducing the unevenness of the toner density in solid-color areas.

The developing sleeve for a magnetic brush developing unit of this invention is a developing sleeve which rotates to carry a magnetic brush formed from developer consisting of carrier and toner while forming said magnetic brush on the circumferential surface thereof, so as to develop an electrostatic latent image on a photosensitive drum with said toner in a developing area where said magnetic brush comes into contact with said photosensitive drum and a predetermined electric field is applied; said developing sleeve comprising a plurality of axially parallel grooves formed at a predetermined pitch in the circumferential direction on the circumferential surface thereof, each groove and each interfacing portion having a cross section gradually and gently curved in the circumferential direction, said interfacing portion being a portion between each groove and its adjacent circumferential surface area.

In a preferred embodiment, said grooves and circumferential surface areas between two adjacent grooves are formed in a sine curve in section.

In a preferred embodiment, each of said grooves is substantially formed in a V-shape with an arc-shaped bottom in section and said interfacing portion between each groove and its adjacent circumferential surface area has an arc-shaped cross section gradually and gently curving in the circumferential direction.

Thus, the electric field strength changes gently in the developing area where the developing sleeve faces the photosensitive drum. This substantially reduces the unevenness in toner density of the resulting developed image, so that no unevenness in toner density of the solid-color areas can be recognized visually.

The developing sleeve for a magnetic brush developing unit according to the invention is a developing sleeve which rotates to carry a magnetic brush formed from developer consisting of carrier and toner while forming said magnetic brush on the circumferential surface thereof, so as to develop an electrostatic latent image on a photosensitive drum with said toner in a developing area where said magnetic brush comes into contact with said photosensitive drum and a predetermined electric field is applied, said photosensitive drum rotating at such a speed that the surface thereof moves slower than that of said developing sleeve; wherein said developing sleeve comprises a plurality of axially parallel grooves formed at a predetermined pitch in the circumferential direction on the circumferential surface thereof, said pitch being equal to or smaller than the circumferential length of said developing area and also being equal to or larger than the difference in travel length between the surface of said developing sleeve and that of the photosensitive drum during the time required for a point on the photosensitive drum to move along the full length of said developing area.

In a preferred embodiment, each of said grooves is provided with angular corners in section.

In a preferred embodiment, each of said grooves and the interfacing portion between each groove and its adjacent circumferential surface area curve gradually and gently in section in the circumferential direction of said developing sleeve.

In a preferred embodiment, said grooves are so arranged as to satisfy the following relation:

$C \times S/D \geqq A$ wherein S is the speed at which the surface of said developing sleeve moves, D is the speed at which the surface of said photosensitive drum moves, A is the pitch at which said grooves are disposed, and C is the circumferential length of said circumferential surface area between two adjacent grooves.

As a result, even if the ratio of the surface speed of the developing sleeve to that of the photosensitive drum is reduced, unevenness in toner density can be prevented in the resulting developed image.

BRIEF DESCRIPTION OF THE DRAWINGS

This invention may be better understood and its numerous objects and advantages will become apparent to those skilled in the art by reference to the accompanying drawings as follows:

FIG. 1 is a sectional view showing part of a developing sleeve for a magnetic brush developing unit according to the present invention.

FIG. 2 is a sectional view showing a modified version of the developing sleeve of FIG. 1.

FIG. 3 is a sectional view showing another example of the developing sleeve according to the invention.

DESCRIPTION OF THE PREFERRED EMBODIMENTS

EXAMPLE 1

Figure 4:
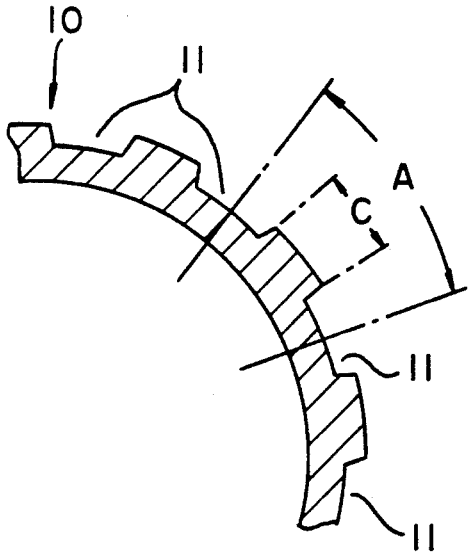
FIG. 4 is a sectional view showing a modified version of the developing sleeve of FIG. 3.

FIG. 1 shows a developing sleeve of the present invention for a magnetic brush developing unit, which is provided with a plurality of axially parallel grooves 11, 11, . . . formed at a predetermined pitch in the circumferential direction on the outer circumferential surface thereof. The grooves 11 and the other circumferential surface areas each being located between two adjacent grooves 11 are formed in, for example, a sine curve in section. Thus, the circumferential surface of the developing sleeve 10 includes the grooves Il each having an arc-shaped cross section gradually and gently curving in the circumferential direction thereof, with the interfacing portion between each groove 11 and its adjacent circumferential surface area (this portion is hereinafter referred to simply as an "interfacing portion") also having an arc-shaped cross section gradually and gently curving in the circumferential direction thereof.

The developing sleeve 10 is rotatably mounted in a developing unit in which carrier and toner rub against each other to be charged, and faces a photosensitive drum 20, for example, with an appropriate distance provided therebetween. Inside the developing sleeve 10, a plurality of magnets are disposed at appropriate spacing on the inner circumferential surface thereof. When the developing sleeve 10 is rotated, a magnetic brush is formed from developer consisting of the carrier and the toner while being carried on the outer circumferential surface thereof. An appropriate electric field is applied to a developing area where the surface of the developing sleeve 10 faces that of the photosensitive drum 20 which is also rotating. In the developing area, the toner in the developer being carried on the surface of the developing sleeve 10 is applied to an electrostatic latent image formed on the photosensitive drum 20, thereby developing the latent image.

Since each groove 11 and each circumferential surface area between two adjacent grooves 11 are formed in an arc shape in section, with the interfacing portion therebetween also having an arc-shaped cross section curving gradually and gently in the circumferential direction of the developing sleeve 10, there are no angular portions over the entire circumferential surface of the developing sleeve 10 including the surface of each groove 11. Therefore, the distance between the surface of the developing sleeve 10 and that of the photosensitive drum 20 does not change abruptly, but changes gently and smoothly in the developing area with the rotation of the developing sleeve 10, and thence, the electric field strength in the developing area between them also changes gradually and gently. Since the developer carried on the surface of the developing sleeve 10 is agitated by the grooves 11 to circulate within the developing area, and since the electric field strength changes gently in the developing area, the toner in the developer being carried in the form of a magnetic brush on the surface of the developing sleeve 10 is allowed, in the developing area, to uniformly adhere to predetermined areas of the electrostatic latent image on the photosensitive drum 20. This assures good development of the electrostatic latent image. As a result, even if the electrostatic latent image on the photosensitive drum 20 has an area to be developed with the toner into a solid-color area, the toner is uniformly applied to the entire surface of that area without sudden changes in density, thereby greatly reducing the unevenness in toner density in the solid-color area of the resultant developed image. In particular, even when the ratio of the surface speed of the developing sleeve 10 to that of the photosensitive drum 20 is reduced, there is almost no density unevenness caused in solid-color areas.

The surface of the developing sleeve 10 need not be formed in a sine curve such as described in the above embodiment, but it may be formed in a shape shown in FIG. 2, in which each groove 11 is substantially formed in a V-shape in section with an arc-shaped bottom and each interfacing portion also has an arc-shaped cross section curving gradually and gently in the circumferential direction of the developing sleeve 10. In this case also, since the electric field strength in the developing area changes gently along the circumferential direction of the developing sleeve 10, almost no unevenness arises in toner density.

The cross section of each groove 11 is not limited to the V shape with its corners curved in an arc shape, but may be formed in a rectangular shape with its corners curved in an arc shape.

EXAMPLE 2

The cross sections of each groove and each interfacing portion need not be formed as shown in the first example, i.e., they need not be formed in a gently curved shape but may have angular corners.

For example, in a developing sleeve 10 such as that shown in FIG. 3, each groove 11 formed on the surface thereof is of a V shape having an angular corner in section, and also, the cross section of each interfacing portion is formed in an angular shape, not curved in an arc shape. Further, the pitch at which the grooves 11 are disposed in the circumferential direction of the developing sleeve 10 is smaller than the circumferential length of the developing area. Therefore, when developing an electrostatic latent image on the photosensitive drum 20, at least one of the grooves 11 and the circumferential surface area between that groove 11 and its adjacent groove 11 are always positioned at the same time in the developing area. This means that, in the developing area, the distance between the surface of the developing sleeve 10 and that of the photosensitive drum 20 differs between the area corresponding to the groove and that corresponding to its adjacent circumferential surface area. As a result, the surface of the developing sleeve 10 is not positioned in the developing area in such a way that only the circumferential surface area between two adjacent grooves 11 or only the bottom surface of one of the grooves 11 faces the surface of the photosensitive drum 20.

Thus, in the developing sleeve 10, when the pitch at which the grooves 11 are disposed is denoted as A, the circumferential length of the surface area between two adjacent grooves 11 is denoted as C, and the circumferential length of the developing area is denoted as B, the pitch A should be equal to or smaller than the circumferential length B of the developing area ($B \geqq A$), and the circumferential length C of the surface area between two adjacent grooves 11 is preferably equal to or smaller than ½ of the circumferential length B of the developing area ($B/2 \geqq C$).

With the arrangement described above, the carrier particles can circulate with an improved flowability within the developing area to allow the toner attached thereto to be more smoothly conveyed to the photosensitive drum 20, as compared with the case in which only the circumferential surface area between two adjacent grooves 11 or only one of the grooves 11 faces the photosensitive drum 20 at a time. Therefore, the toner is uniformly applied to the predetermined areas of the electrostatic latent image on the photosensitive drum 20, thereby greatly reducing unevenness in toner density of the solid-color area of the resultant developed image.

The cross section of each groove 11 need not be of a V-shape as shown in FIG. 3, but it may be rectangular as shown in FIG. 4. In this case also, the pitch A is equal to or smaller than the circumferential length B of the developing area ($B \geqq A$), and it is more preferable that the circumferential length C of each surface area between two adjacent grooves 11 is equal to or smaller than ½ of the circumferential length B of the developing area ($B/2 \geqq C$). Thus, at least one of the grooves 11 and the circumferential surface area between that groove 11 and its adjacent groove 11 are always positioned at the same time in the developing area. This improves the flowability of the carrier particles within the developing area, thereby allowing the toner attached thereto to be more smoothly conveyed to the photosensitive drum 20.

In the developing sleeve 10 such as those shown in FIGS. 3 and 4, the pitch A is set in accordance with the rotation speed of the developing sleeve 10 and the photosensitive drum 20. They rotate at such a speed that the surface of the developing sleeve 10 moves at a higher speed than that of the photosensitive drum 20. The pitch A is set to be equal to or larger than the distance which covers the difference in travel length between the surface of the developing sleeve 10 and that of the photosensitive drum 20 during the time required for a point on the photosensitive drum 20 to move along the full length of the developing area.

The inventors of the present invention carried out experiments on the relationship among the pitch A, the circumferential length C of each surface area between two adjacent grooves 11, and the ratio of the surface speed S of the developing sleeve 10 to the surface speed D of the photosensitive drum 20.

In Experiment 1, a developing sleeve 10 was used which had grooves 11 having a V-shaped cross section as shown in FIG. 3. The pitch A was 2.14 mm, and the circumferential length C of each surface area between two adjacent grooves 11 was 1.34 mm. Solid-color images were formed with the ratio of the surface speed S of the developing sleeve 10 to the surface speed D of the photosensitive drum 20 set at 2.15, 1.85, 1.55, and 1.25, respectively. The results are shown in Table 1.

Next, in Experiment 2, the same experiment as sleeve 10 which had grooves 11 having a rectangular cross section as shown in FIG. 4, the pitch A being 3.00 mm, and the circumferential length C of each surface area between two adjacent grooves 11 being 1.50 mm. The results shown in Table 1 were obtained.

Further, in Experiment 3, the same experiment as Experiment 2 was conducted, except that the circumferential length C of each surface area between two adjacent grooves 11 was 2.00 mm. The results shown in Table 1 were obtained.

In any of the above cases, no unevenness in density was visually recognized when the condition $A \leqq C \times S/D$ was satisfied.

In this way, when the relationship between the arrangement of the grooves 11 formed on the developing sleeve 10 and the ratio of the surface speed S of the developing sleeve 10 to the surface speed D of the photosensitive drum 20 satisfies the condition $A \leqq C \times S/D$, unevenness in density is not caused in the solid-color areas on the resulting developed image.

TABLE 1

| | A | C | S/D | C × S/D | Unevenness in toner density of solid-color area |
|---|---|---|---|---|---|
| Example 1 | 2.14 | 1.34 | 2.15 | 2.881 | Not observed |
| | 2.14 | 1.34 | 1.85 | 2.479 | Not observed |
| | 2.14 | 1.34 | 1.55 | 2.077 | Observed |
| | 2.14 | 1.34 | 1.25 | 1.675 | Observed |
| Example 2 | 3.00 | 1.50 | 2.15 | 3.225 | Not observed |
| | 3.00 | 1.50 | 1.85 | 2.775 | Observed |
| | 3.00 | 1.50 | 1.55 | 2.325 | Observed |
| | 3.00 | 1.50 | 1.25 | 1.875 | Observed |
| Example 3 | 3.00 | 2.00 | 2.15 | 4.300 | Not observed |
| | 3.00 | 2.00 | 1.85 | 3.700 | Not observed |
| | 3.00 | 2.00 | 1.55 | 2.900 | Observed |
| | 3.00 | 2.00 | 1.25 | 2.500 | Observed |

EXAMPLE 3

Figure 5:
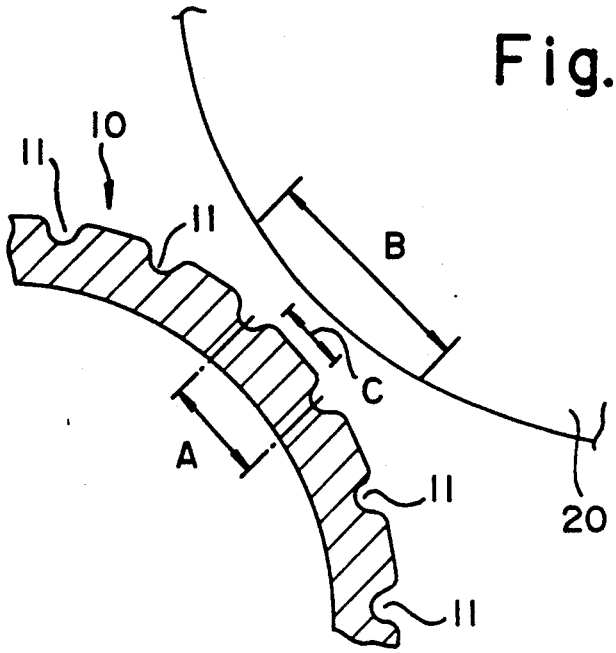
FIG. 5 is a sectional view showing a further example of the developing sleeve according to the invention.

FIG. 5 shows still another developing sleeve 10 of the invention, in which the grooves 11 and the interfacing portions are both arc-shaped in cross section curving gradually and gently in the circumferential direction thereof, and the pitch A at which the grooves 11 are formed is equal to or smaller than the circumferential length B of the developing area. The pitch A is also set to be equal to or larger than the difference in travel length between the surface of the developing sleeve 10 and that of the photosensitive drum 20 during the time required for a point on the photosensitive drum 20 to move along the full length of the developing area. In this case also, it is preferable that the circumferential length C of each surface area between two adjacent grooves 11 is equal to or smaller than $\frac{1}{2}$ of the circumferential length B of the developing area ($B/2 \geqq C$), and that the pitch A and the length C satisfy the relationship of "$A \leqq C \times S/D$" with respect to the surface speed S of the developing sleeve 10 and the surface speed D of the photosensitive drum 20. Thus, in this example, the prevention of the toner density unevenness in an solid-color area can also be assured.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A developing sleeve for a magnetic brush developing unit, which rotates a carry a magnetic brush formed from developer consisting of carrier and toner while forming said magnetic brush on a circumferential surface thereof, so as to develop an electrostatic latent image on a photosensitive drum with said toner in a developing area where said magnetic brush comes into contact with said photosensitive drum and a predetermined electric field is applied, wherein said developing sleeve comprises a plurality of axially parallel grooves formed at a predetermined pitching a circumferential direction on the circumferential surface thereof, said developing sleeve further comprising circumferential surface area portions having a center of curvature as a center of said developing sleeve, said circumferential surface area portions alternating in a circumferential direction with said plurality of axially parallel grooves, wherein each of said plurality of axially parallel grooves has a substantially U-shaped or V-shaped cross section, said cross section comprising an angled portion and an open portion, each said open portion positioned radially outwardly along a radius of said developing sleeve from each said angled portion and each said open portion having a length in the circumferential direction of said developing sleeve less than a length in the circumferential direction of said developing sleeve of each of said respective circumferential surface area portions.

2. A developing sleeve according to claim 1, wherein each of said grooves comprises an interfacing portion between each groove and its adjacent circumferential surface area portion and has an arc-shaped cross section gradually and gently curving in the circumferential direction.

3. A developing sleeve for a magnetic brush developing unit, which rotates to carry a magnetic brush formed from developer consisting of carrier and toner while forming said magnetic brush on a circumferential surface thereof, so as to develop an electrostatic latent image on a photosensitive drum with said toner in a developing area where said magnetic brush comes into contact with said photosensitive drum and a predetermined electric field is applied, said photosensitive drum rotating at such a speed that the surface thereof moves slower than that of said developing sleeve, wherein said developing sleeve comprises a plurality of axially parallel grooves formed at a predetermined pitch in a circumferential direction on the circumferential surface thereof, said pitch being equal to or smaller than a circumferential length of said developing area and also being equal to or larger than a difference in travel length between the surface of said developing sleeve and that of the photosensitive drum during a time required for a point on the photosensitive drum to move along a full length of said developing sleeve is less than or equal to twice a circumferential speed of the photosensitive drum.

4. A developing sleeve according to claim 3 wherein each of said grooves is provided with angular corners in section.

5. A developing sleeve according to claim 3 wherein each of said grooves and an interfacing portion between each groove and its adjacent circumferential surface area curve gradually and gently in section in the circumferential direction of said developing sleeve.

6. A developing sleeve according to claim 3 wherein said grooves are so arranged as to satisfy the following relation:

$$C \times S/D \geqq A$$

wherein S is the speed at which the surface of said developing sleeve moves, D is the speed at which a surface of said photosensitive drum moves, A is the pitch at which said grooves are disposed, and C is the circumferential length of a circumferential surface area between two adjacent grooves.

* * * * *

UNITED STATES PATENT AND TRADEMARK OFFICE

CERTIFICATE OF CORRECTION

PATENT NO. : 5,153,376
DATED : October 6, 1992
INVENTOR(S) : Shoji Tomita

It is certified that error appears in the above-identified patent and that said Letters Patent is hereby corrected as shown below:

Column 8, lines 30; in Claim 3 between "developing" and "sleeve" insert --area such that a circumferential speed of the developing--.

Signed and Sealed this

Third Day of August, 1999

*Attest:*

*Attesting Officer*

Q. TODD DICKINSON

*Acting Commissioner of Patents and Trademarks*

US005153376C1

(12) EX PARTE REEXAMINATION CERTIFICATE (7328th)

United States Patent
Tomita

(10) Number: US 5,153,376 C1
(45) Certificate Issued: Jan. 26, 2010

(54) DEVELOPING SLEEVE WITH AXIALLY PARALLEL GROOVES FOR A MAGNETIC BRUSH DEVELOPING UNIT

(75) Inventor: Shoji Tomita, Yao (JP)

(73) Assignee: Kyocera Mita Corporation, Fushimi-Ku, Kyoto (JP)

Reexamination Request:
No. 90/010,298, Sep. 30, 2008

Reexamination Certificate for:

| | |
|---|---|
| Patent No.: | **5,153,376** |
| Issued: | **Oct. 6, 1992** |
| Appl. No.: | **07/655,514** |
| Filed: | **Mar. 6, 1990** |

Certificate of Correction issued Aug. 3, 1999.

(30) Foreign Application Priority Data

Mar. 9, 1989 (JP) ..... 1-56798

(51) Int. Cl.
*G03G 15/09* (2006.01)

(52) U.S. Cl. ..... 399/276; 399/106

(58) Field of Classification Search ..... None
See application file for complete search history.

(56) References Cited

FOREIGN PATENT DOCUMENTS

| | | |
|---|---|---|
| JP | S55-155258 | 4/1954 |
| JP | S55-48768 | 4/1980 |
| JP | S60-186458 | 12/1985 |
| JP | H1-97362 | 6/1989 |

*Primary Examiner*—Linh M. Nguyen

(57) ABSTRACT

A developing sleeve for a magnetic brush developing unit, which is provided with a plurality of axially parallel grooves formed at a predetermined pitch in the circumferential direction on the surface thereof, is disclosed. Each of the grooves and the interfacing portion between each groove and its adjacent circumferential surface curve gradually and gently in section in the circumferential direction of the developing sleeve. The pitch for the formation of the grooves is set to be equal to or larger than the difference in travel length between the surface of the developing sleeve and that of a photosensitive drum during the time required for a point on the photosensitive drum to move along the full length of a developing area.

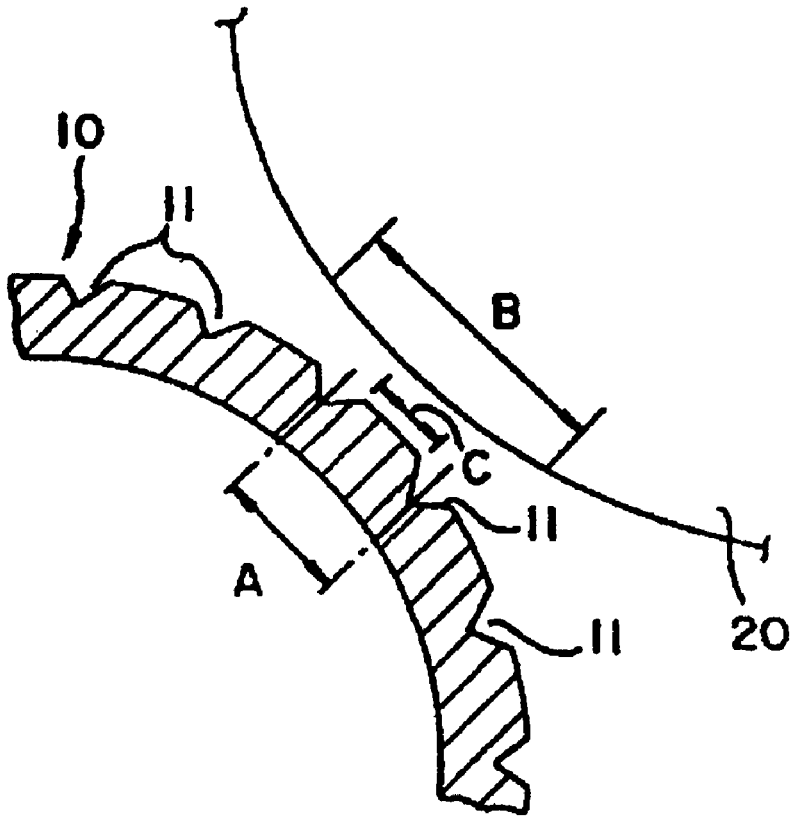

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 6 is cancelled.

Claim 1 is determined to be patentable as amended.

Claim 2, dependent on an amended claim, is determined to be patentable.

New claim 7 is added and determined to be patentable.

Claims 3–5 were not reexamined.

1. A developing sleeve for a magnetic brush developing unit, which rotates to carry a magnetic brush formed from developer consisting of carrier and toner while forming said magnetic brush on a circumferential surface thereof, so as to develop an electrostatic latent image on a photosensitive drum with said toner in a developing area where said magnetic brush comes into contact with said photosensitive drum and a predetermined electric field is applied, wherein said developing sleeve comprises a plurality of axially parallel grooves formed at a predetermined pitching a circumferential direction on the circumferential surface thereof, said developing sleeve further comprising circumferential surface area portions having a center of curvature as a center of said developing sleeve, said circumferential surface area portions alternating in a circumferential direction with said plurality of axially parallel grooves, wherein each of said plurality of axially parallel grooves has a substantially U-shaped or V-shaped cross section, said cross section comprising an angled portion and an open portion, each said open portion positioned radially outwardly along a radius of said developing sleeve from each said angled portion and each said open portion having a length in the circumferential direction of said developing sleeve less than a length in the circumferential direction of said developing sleeve of each of said respective circumferential surface area portions

*wherein said grooves are so arranged as to satisfy the following relation:*

$$CxS/D>A$$

*wherein S is the speed at which the surface of said developing sleeve moves, D is the speed at which a surface of said photosensitive drum moves, A is the pitch at which said grooves are disposed, and C is the circumferential length of a circumferential surface area between two adjacent grooves.*

*7. A developing sleeve according to claim 1, wherein the pitch A is equal to or smaller than a circumferential length B of the developing area, and the circumferential length C is equal to or smaller than ½ of the circumferential length B.*

* * * * *